US007329150B2

(12) United States Patent
Ju

(10) Patent No.: US 7,329,150 B2
(45) Date of Patent: Feb. 12, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/474,963

(22) Filed: Jun. 27, 2006

(65) Prior Publication Data

US 2007/0298657 A1 Dec. 27, 2007

(51) Int. Cl.
*H01R 13/648* (2006.01)

(52) U.S. Cl. ..... 439/608; 439/931

(58) Field of Classification Search ..... 439/931, 439/607, 608

See application file for complete search history.

(56) References Cited

U.S. PATENT DOCUMENTS 3,628,105 A * 12/1971 Sakai et al. ..... 257/664
5,713,762 A * 2/1998 Mitra et al. ..... 439/607
6,947,012 B2 * 9/2005 Aisenbrey ..... 343/906
7,160,151 B1 * 1/2007 Rigby et al. ..... 439/607

* cited by examiner

*Primary Examiner*—Neil Abrams
*Assistant Examiner*—Phuongchi Nguyen
(74) *Attorney, Agent, or Firm*—Rosenberg, Klein & Lee

(57) ABSTRACT

An electrical connector, includes an insulating housing having a plurality of terminal receiving holes, and a plurality of conductive terminals received in the receiving holes respectively. The insulating housing has a metal layer for shielding the conductive terminals from electromagnetic interference, and the metal layer is formed on the insulating housing via physical vapor deposition (PVD). In contrast to traditional methods, the electrical connector of the present invention connects to a mating electrical component effectively.

6 Claims, 1 Drawing Sheet

ELECTRICAL CONNECTOR

BACKGROUND OF THE INVENTION

1. Field of the Invention

The present invention relates generally to an electrical connector and more particularly to an electrical connector that can effectively connect to a mating electrical component.

2. Description of Related Art

At present, a traditional electrical connector includes an insulating housing and conductive terminals received in the insulating housing. The insulating housing has a terminal receiving trough for receiving the conductive terminals. Wherein, the conductive terminal has a fixed portion, a contacting portion which is located at an end of the fixed portion, and a welding portion which is located at the other end of the fixed portion. However, the development of electronic technology has affected the amount of electromagnetic interference that builds up between the adjacent conductive terminals within the electrical connector and the outside surface of the electrical component. This causes the electrical connector to be unable to connect to a mating electrical component effectively and influences the electrical connector's performance. Therefore, an electrical connector which overcomes these faults is necessary.

SUMMARY OF THE INVENTION

The primary object of the present invention is to provide an electrical connector which connects with a mating electrical component effectively.

For achieving the above object, the present invention provides an electrical connector comprising an insulating housing having a plurality of terminal receiving holes, and a plurality of conductive terminals received in the receiving holes respectively. The insulating housing has a metal layer for shielding the conductive terminals from electromagnetic interference, and the metal layer is formed on the insulating housing via physical vapor deposition (PVD). In contrast to the prior art, the electrical connector of the present invention effectively connects to a mating electrical component.

For achieving the object stated above, it is to be understood that both the foregoing general description and the following detailed description are exemplary, Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following Detailed Description of the Invention.

DETAILED DESCRIPTION OF PREFERRED EMBODIMENTS

Figure 1:
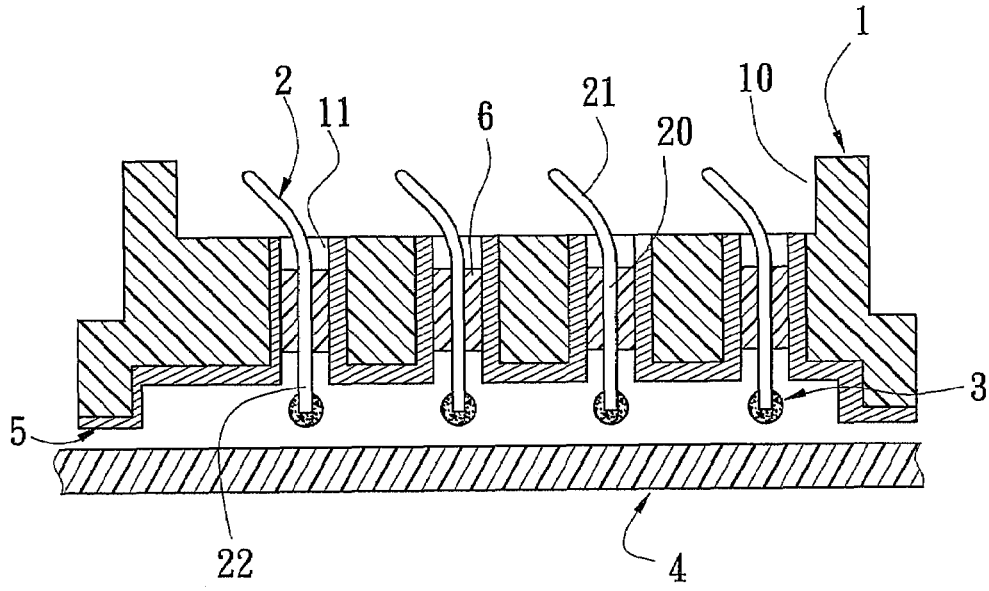
FIG. 1 is a cross-sectional view of the first embodiment of the present invention.

Please refer to FIG. 1, which is a cross-sectional view of the first embodiment of the present invention. According to the view of the present invention, an electrical connector comprises an insulating housing 1 having a plurality of terminal receiving holes 11 and a plurality of conductive terminals 2. The conductive terminals 2 are received in the terminal receiving holes 11 respectively, the insulating housing 1 has a metal layer 5 for shielding from electromagnetic interference, and the metal layer 5 is formed on the insulating housing 1 via physical vapor deposition (PVD) (by evaporating or sputtering), and formed on a specified part of the electrical connector for shielding (such as using other methods of physical vapor deposition), the metal layer 5 shields an unnecessary plating part by using a fixture and exposes the plating part so that the metal layer 5 can be plated. The metal layer 5 is formed on a bottom surface of the insulating housing 1 and the terminal receiving holes 11.

Moreover, the electrical connector of the present invention further comprises a PCB 4 (Printed Circuit Board), and the metal layer 5 has at least one part disposed on the PCB 4 by welding. The conductive terminals 2 are welded on the PCB 4 by solder balls 3. At least one part of the metal layer 5 is disposed on the PCB 4 by welding for making the electrical connector attach on to the PCB 4 firmly.

Moreover, a plurality of insulating blocks 6 respectively received in the terminal receiving holes 11, each conductive terminal 2 is fixed in place for insulating against the metal layer 5. The insulating housing 1 has a hollow space 10 for accommodating a mating electrical component (such as a chip module). In addition, each of the conductive terminals 2 is formed as an integral component. Each of the conductive terminals 2 has a fixed portion 20 which is located at the insulating block 6, a contacting portion 21 which is upwardly extended from the fixed portion 20, and a conducting portion 22 which is downwardly extended from the fixed portion 20 and connected to the PCB 4 electrically. The conducting portion 22 connects to the PCB 4 electrically via the welding of a solder ball 3 that connects the electrical connector to the mating electrical component effectively.

Figure 2:
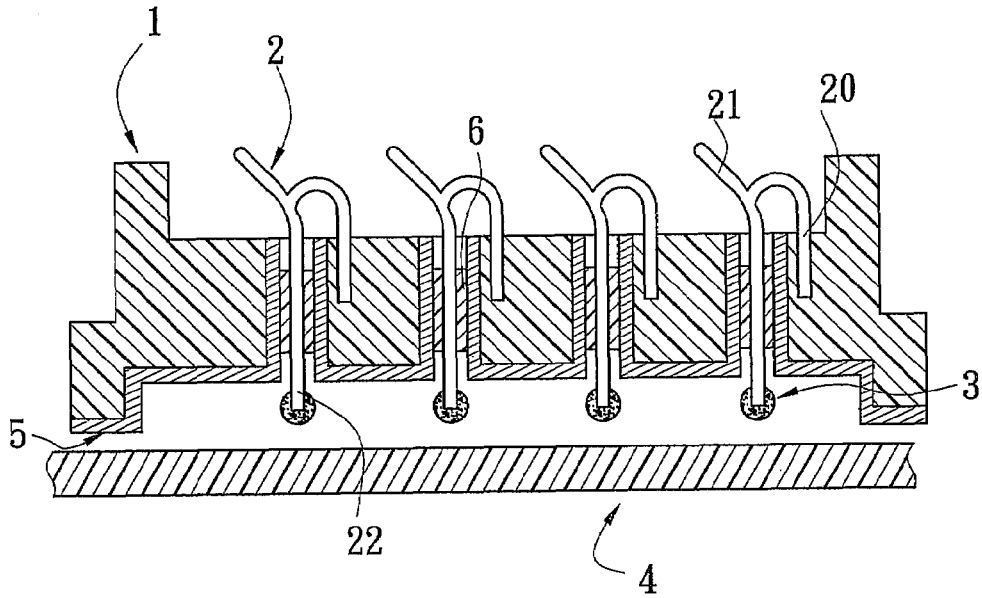
FIG. 2 is a cross-sectional view of the second embodiment of the present invention.

Please refer to FIG. 2, which is a cross-sectional view of the second embodiment of the present invention, according to the view of the present invention. The second embodiment differs from the first embodiment in that each of the conductive terminals 2 has a conducting portion 22, a contacting portion 21 which is upwardly extended from the conducting portion 22 and bent, and a fixed portion 20 which is fixed in the insulating housing 1 without contacting with the metal layer 5. The fixed portion 20 is bent and extends from the contact portion 21 (or the fixed portion 20 is bent and extends from the conducting portion 22). This design avoids conduction between the metal layer 5 and the conductive terminal 2 and shields the conductive terminals 2 from electrical magnetic interference. The present invention has a metal layer 5 for shielding the conductive terminals 2 from electromagnetic interference, and connects an electrical connector to a mating electrical component effectively.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electrical connector, comprising:

an insulating housing having a plurality of terminal receiving holes, the insulating housing having a continuous metal layer formed on a lower surface thereof, and on sidewalls of the plurality of terminal receiving holes, the metal layer being formed by physical vapor deposition (PVD), the metal layer being joined to a printed circuit board by solder;

a plurality of conductive terminals respectively received in the plurality of terminal receiving holes, wherein the metal layer provides shielding of the conductive terminals from electrical magnetic interference, each of the conductive terminals having a conducting portion passing through a respective one of the plurality of terminal receiving holes, a contacting portion upwardly extended from the conducting portion and bent, and a fixed portion extending from the conducting portion to a distal end portion fixed in an upper side of the insulating housing for supporting the conducting portion to pass through a corresponding terminal receiving hole in spaced relationship to the metal layer, whereby the conducting portion is insulated from the metal layer on the sidewall of the receiving hole by only the spacing therebetween.

2. The electrical connector as claimed in claim 1, wherein the method of physical vapor deposition (PVD) is evaporating or sputtering.

3. The electrical connector as claimed in claim 1, further comprising a plurality of insulating blocks respectively received in the terminal receiving holes, wherein each conductive terminal is insulated from the metal layer by a respective insulating block.

4. The electrical connector as claimed in claim 1, wherein the insulating housing has a hollow space for accommodating a mating electrical component.

5. The electrical connector as claimed in claim 1, wherein the insulating housing has a pair of projecting portions extending from the lower surface thereof, the continuous metal layer being formed on the projecting portions.

6. An electrical connector, comprising:

an insulating housing having a plurality of terminal receiving holes, the insulating housing having a metal layer formed on a lower surface thereof and on sidewalls of the plurality of terminal receiving holes, the metal layer being formed by physical vapor deposition (PVD); and a plurality of conductive terminals respectively received in the plurality of terminal receiving holes, each of the conductive terminals has a fixed portion, a contacting portion extending upwardly from the fixed portion, and a conducting portion extending downwardly from the fixed portion to pass through a corresponding one of the plurality of terminal receiving holes for electrically connecting to a printed circuit board, the fixed portion of each of the plurality of conductive terminals having a distal end affixed to a portion of the insulating housing disposed adjacent to a corresponding one of the plurality of terminal receiving holes, whereby the fixed portion of each conductive terminal supports the conducting portion to pass through the corresponding terminal receiving hole in spaced relationship to the metal layer formed on the sidewall thereof and the conducting portion is thereby insulated from the metal layer on the sidewall of the receiving hole by only the spacing therebetween.

* * * * *